US006068369A

United States Patent [19]

Saito et al.

[11] Patent Number: 6,068,369

[45] Date of Patent: May 30, 2000

[54] INK JET HEAD SUBSTRATE, A METHOD FOR MANUFACTURING THE SUBSTRATE, AN INK JET RECORDING HEAD HAVING THE SUBSTRATE, AND A METHOD FOR MANUFACTURING THE HEAD

[75] Inventors: Ichiro Saito, Yokohama; Yoshiyuki Imanaka, Kawasaki; Teruo Ozaki, Yokohama; Toshimori Miyakoshi, Kawasaki; Muga Mochizuki, Yokohama, all of Japan

[73] Assignee: Canon Kabushiki Kaisha, Tokyo, Japan

[21] Appl. No.: 08/915,697

[22] Filed: Aug. 21, 1997

[30] Foreign Application Priority Data

Aug. 22, 1996 [JP] Japan ..... 8-221403

[51] Int. Cl.[7] ..... B41J 2/05

[52] U.S. Cl. ..... 347/62

[58] Field of Search ..... 347/62, 63

[56] References Cited

U.S. PATENT DOCUMENTS 4,105,892 8/1978 Tashiro et al. ..... 219/216
4,723,129 2/1988 Endo et al. ..... 346/1
4,740,796 4/1988 Endo et al. ..... 346/1.1

FOREIGN PATENT DOCUMENTS 0 630 749 A2 12/1994 European Pat. Off. .
5-338175 12/1993 Japan .
7-125218 5/1995 Japan .

*Primary Examiner*—John Barlow
*Assistant Examiner*—Michael S Brooke
*Attorney, Agent, or Firm*—Fitzpatrick, Cella, Harper & Scinto

[57] ABSTRACT

A substrate is formed for use of an ink jet recording head provided with a plurality in heat generating members for generating thermal energy to be utilized for discharging ink, an interlayer film arranged for the lower layer of each of said heat generating members, and a protection layer for protecting said heat generating member. Each of the heat generating members of the substrate is structured by metal and insulator, and at the same time, the rate of metal content in the vicinity of the interfaces of the heat generating member becomes smaller than that in the center of the heat generating member in the film thickness direction thereof. With the structure of such member thus arranged, it is made possible to prevent or suppress interlayer peelings and cracks from taking place in each of the heat generating resistive layers where temperature changes are made intensely due to thermal cycle.

6 Claims, 3 Drawing Sheets

INK JET HEAD SUBSTRATE, A METHOD FOR MANUFACTURING THE SUBSTRATE, AN INK JET RECORDING HEAD HAVING THE SUBSTRATE, AND A METHOD FOR MANUFACTURING THE HEAD

BACKGROUND OF THE INVENTION

1. Field of the Invention

The present invention relates to a substrate that constitutes an ink jet head (hereinafter, simply referred to as an ink jet head) for discharging functional liquid, such as ink, to recording media including paper sheet, plastic sheet, cloth, commodity, and the like, in order to record and print characters, symbols, images, and the like, while executing related operations. The invention also relates to a method for manufacturing such substrate, and an ink jet head formed by use of such substrate, as well as to a method for manufacturing such head.

2. Related Background Art

The ink jet recording method has, in recent years, attracted more attention because it operates more suitably for recording images in higher precision at higher speeds, while with this method, the recording head and apparatuses are made smaller and suitably adaptable for recording in color. (For example, refer to the specifications of U.S. Pat. Nos. 4,723,129 and 4,740,796.)

FIG. 1 is a view which shows the general structure of the principle part of the head substrate used for an ink jet recording head described above in accordance with one embodiment of the present invention.

In FIG. 1, the ink jet recording head is provided with a plurality of discharge openings 1001. Also, on the substrate 1004, the electrothermal transducing devices 1002 that generate thermal energy to be utilized for discharging ink from these openings are arranged for each of the ink flow paths 1003, respectively. Each of the electrothermal transducing devices are formed mainly by the heat generating member 1005, the electrode wiring 1006 that supplies electric power to it, and an insulation film that protects them.

Also, each of the ink flow paths 1003 are formed by a ceiling plate having a plurality of flow path walls 1008, which is adhesively bonded, while its relative positions to the electrothermal transducing devices and others on the substrate 1004 are adjusted by means of image processing or the like. The end of each of the ink flow paths 1003 on the side opposite to the discharge opening 1001 is conductively connected with a common liquid chamber 1009. In this common liquid chamber 1009, where ink supplied from an ink tank (not shown) is retained. Ink supplied to the common liquid chamber 1009 is conducted to each of the ink flow paths 1003 from the chamber, and is held in the vicinity of each discharge opening by means of a meniscus that the ink forms in such portion. At this juncture, when the electrothermal transducing devices are selectively driven, ink on the heat activation surface is abruptly heated by the utilization of thermal energy thus generated to bring about film boiling. Ink is discharged by means of its impulsive force at that time.

FIG. 2 is a cross-sectional view of the substrate for use of an ink jet recording head, taken along line 2—2 corresponding to an ink path represented in FIG. 1.

In FIG. 2, a reference numeral 2001 designates a silicon substrate, and 2002, a heat accumulation layer. A reference numeral 2003 designates an interlayer film formed by SiO film, SiN film, or the like, which dually functions to accumulate heat; 2004, a heat generating resistive layer; 2005, a metal wiring formed by Al, Al—Si, Al—Cu, or the like; and 2006, a protection layer formed by SiO film, SiN film, or the like. Also, a reference numeral 2007 designates an anti-cavitation film that protects the protection film 2006 from the chemical and physical shocks following the heat generation of the heat generating resistive layer 2004. Also, a reference numeral 2008 designates the heat activating portion of the heat generating resistive layer 2004.

Now, this heat activating portion is formed by the heat generating resistive layer 2004, the protection layer 2006 that protects the heat generating resistive layer 2004 from ink, and the interlayer film 2003 that gives thermal energy generated by the heat generating resistive layer to ink efficiently.

The heat activating portion of the ink jet head is under a severe environment, such as receiving mechanical shocks resulting from the cavitation caused by the repeated foaming and defoaming of ink; being exposed to erosion; and also, exposed to the considerable degree of temperature changes, up and down, in an extremely short period of 0.1 to 10 $\mu$sec, among some other severe conditions. Therefore, the stabilization characteristics of the heat generating resistive layer 2004 itself, the characteristics of the protection layer 2006 and the interlayer film 2003 that sandwich the heat generating resistive layer 2004, with respect to the environment under which these elements are used, are the important factors that determine the performance of the ink jet head, such as its discharge stability and life.

As the heat generation resistive layer 2004 used for the ink jet head described above, TaN film, $HfB_2$ film, or the like is generally used at present. Here, it is known that the stabilization characteristic of the heat generation resistive layer, particularly the rate of resistance changes at the time of repeated recording for a long time, depends largely on the composition of the TaN film. Of the heat generating members, it is known that the one formed by tantalum nitride which contains $TaN_{0.8hex}$ has a smaller rate of resistance changes at the time of repeated recording for a long time as described above, and that it is excellent in its discharge stability (see Japanese Pat. Laid-Open Application No. 7-125218).

Also, for the protection layer and the interlayer film used for the ink jet head described above, it is required to provide excellent capability of heat resistance, stable oxidation, insulation, resistance to breakage, and close contactness with the heat generation resistive layer. At present, $SiO_2$, SiN, or some other inorganic compound is used in general.

In recent years, ink jet printers have been developed rapidly and put on the market widely. Along with such development, it is required to provide recorded images of higher precision. In order to meet such demand for higher precision of recorded images, there may be cited a method of making the size of ink droplets smaller still. To this end, the heat generating members should be provided with higher resistance. However, the limit of the specific resistance value of the material used for the conventional heat generating members described above is approximately 200 to 300 $\mu\Omega\cdot$cm. No sufficient resistance value is obtainable or this particular purpose. Then, if many heat generating members conventionally in use should be arranged to meet the requirement of highly precise recording, the electric current value becomes very high because of the inability of obtaining sufficient resistance value. A great load is given to the heat generating members, making its life much shorter.

Also, it is required to record at higher speeds, because such highly precise image recording may considerably increase the numbers of droplets to be discharged. Consequently, the heat generating members should be driven at a high temperature in a shorter period of time at high speeds. This requires each of the heat generating resistive layers to provide more stabilized discharge capability, and thermal stability as well.

For the ink jet recording head, short pulses should be given at a high temperature to heat ink to be foamed and discharged. Therefore, the protection layer 2006 and the interlayer film 2003 are heated to considerably high temperatures due to the heat which is generated by the heat generating member 2004. Further, there are some cases that the interfaces of the protection layer and interlayer film or the portions having weaker film texture are damaged locally due to heat generated by the heat generating member following the repeated cycle of heating and cooling. Then, if electric power should be applied in shorter pulses in order to attempt the high-speed operation of the ink jet recording head, there are some cases that ink enters such interfaces or portions resulting in electric erosion, and leading to the problem that breakage of the heat generating resistive layer 2004 takes place.

Meanwhile, it is proposed in the specification of Japanese Patent Laid-Open Application No. 5-338175 that at least the portions of the heat generating resistive layer 2004 on the interfaces with the protection layer 2006 and the interlayer film 2003 are made to contain the materials of the protection layer 2006 and the interlayer film 2003 as the components of the material that forms the heat generating resistive layer, and that the components of material of the heat generating resistive layer are made to vary in the film thickness direction. In this manner, the thermal stress, which is caused by the difference in the thermal expansion coefficient, may be reduced at each interface between the layers, thus attempting the enhancement of its durability against the thermal stress.

However, in accordance with the structure proposed as described above, the formation thereof is made by the material of the heat generating member having crystal structures. As a result, the central portion of the heat generating member is formed only by such material in the film thickness direction, and the film thickness is made thinner because the specific resistance value is also low. Inevitably, therefore, this structure necessitates more rigid control in making the required film formation. At the same time, the temperature gradient of the heat generating member becomes greater in the film thickness direction. As a result, the proposed formation of the structure cannot meet the requirements sufficiently when smaller-sized heat generating members should be driven at higher speeds as described above.

SUMMARY OF THE INVENTION

The present inventor et al. have diligently studied such problems as discussed above to find the solution thereof. As a result, they have successfully obtained an ink jet head, which is excellent in its discharge stability without causing any interlayer peeling and cracks when discharging ink continuously for a long time, by providing the new structural formation of the heat generation resistive layer.

The present invention is, therefore, designed with a view to attaining such objectives as described above with the provision of the following structures:

In other words, a substrate for use in an ink jet recording head provided with a plurality of heat generating members for generating thermal energy to be utilized for discharging ink, an interlayer film arranged for the lower layer of each of the heat generating members, and a protection layer for protecting the heat generating member, wherein the heat generating member thereof is structured by metal and insulator, at the same time, the rate of metal content in the vicinity of the interfaces of the heat generating member becoming smaller than that in the center of the heat generating member in the film thickness direction thereof.

Also, a method for manufacturing a substrate for use in an ink jet recording head provided with a plurality of heat generating members for generating thermal energy to be utilized for discharging ink, an interlayer film arranged for the lower layer of each of the heat generating members, and a protection layer for protecting the heat generating member, comprising the following step of:

forming each of the heat generating members by means of multiple reactive sputtering with metal and Si or Si insulator as the respective targets, at the same time, the rate of metal with respect to insulator in the vicinity of the interfaces of the heat generating member being smaller than that in the center of the heat generating member in its film thickness direction.

Also, a method for manufacturing an ink jet recording head comprising a substrate for use in an ink jet recording head provided with a plurality of heat generating members for generating thermal energy to be utilized for discharging ink, an interlayer film arranged for the lower layer of each of the heat generating members, and a protection layer for protecting the heat generating member; discharge openings for discharging ink; and ink flow paths conductively connected with the discharge openings, at the same time containing the heat generating members, wherein each of the heat generating members being formed by means of multiple reactive sputtering with metal and Si or Si insulator as the respective targets, at the same time, the rate of metal content in the vicinity of the interfaces of the heat generating member becoming smaller than that in the center of the heat generating member in the film thickness direction thereof.

For the present invention, it is possible to control the compositional rate easily with more freedom in the film thickness direction by use of the compound of metal and insulator that can present high resistance in the heat generating resistive layer capable of executing highly precise image recording, and also, it is possible to make the temperature gradient uniform in the film thickness direction. In other words, whereas the central portion of the conventional heat generating resistive layer should be formed only by the material of the heat generating member in its film thickness direction, it is made possible to change the composition of the material of the heat generating member continuously in the film thickness direction, hence enabling the temperature gradient to be uniform in the film thickness direction. Particularly, by use of the material of the protection layer and the interlayer film as the insulator that forms the heat generating resistive layer, the temperature gradient of the interlayer film-heat generating resistive layer-protection layer is made uniform among them in a better condition. Then, the occurrence of interlayer peelings and cracks is prevented even when used continuously for a long time to make it possible to attain the production of an ink jet recording head having an excellent stability of discharges.

DETAILED DESCRIPTION OF THE PREFERRED EMBODIMENTS

Figure 2:
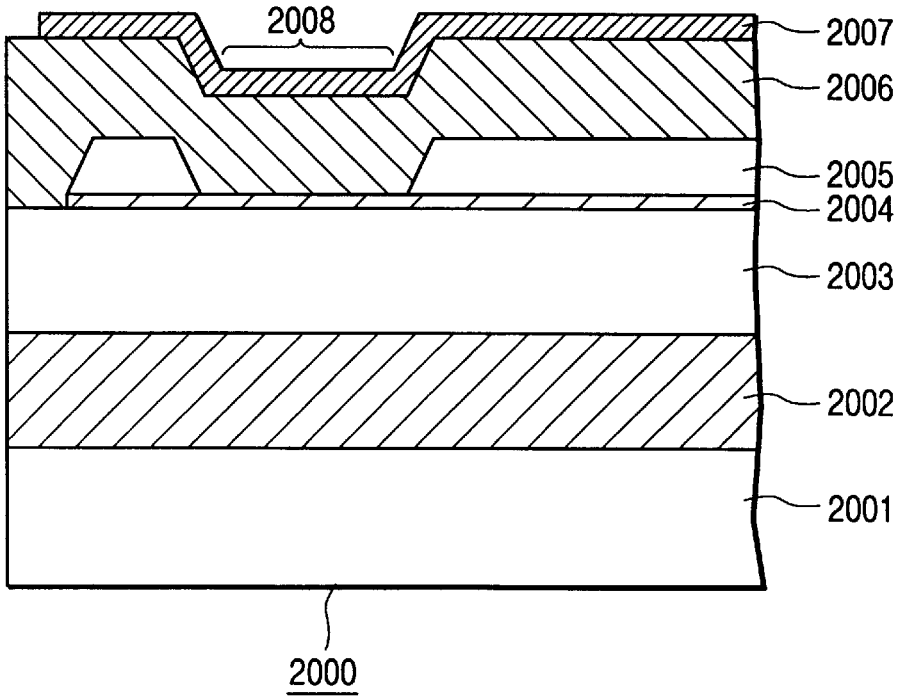
FIG. 2 is a cross-sectional view which shows the substrate, taken along 2—2 in FIG. 1
Figure 3:
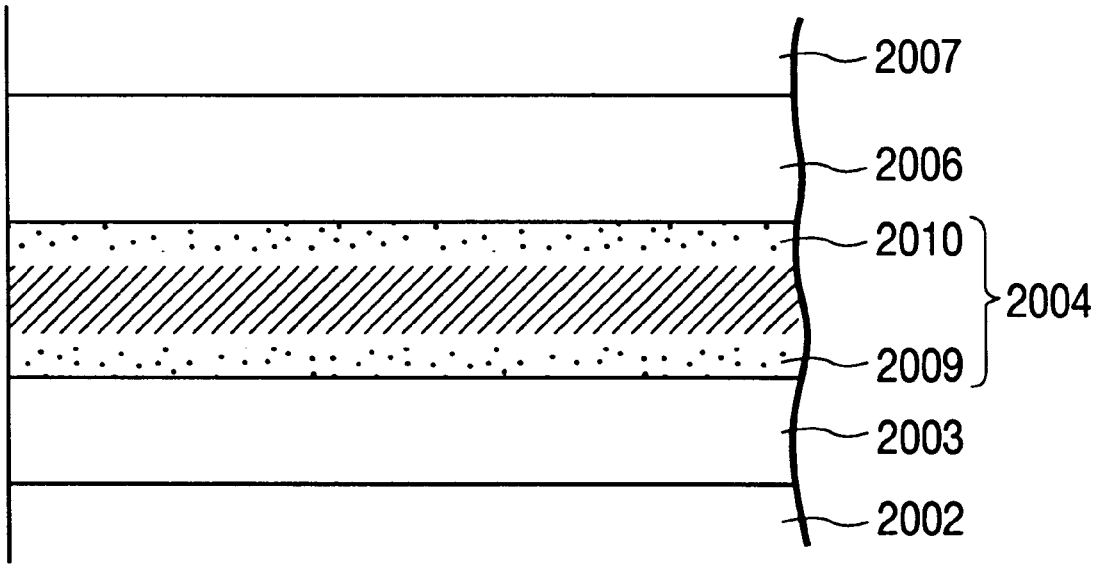
FIG. 3 is a partly enlarged view of the substrate shown in FIG. 2.

FIG. 3 is an enlarged view which shows a part of the substrate represented in FIG. 2, which is prepared for the detailed description of the heat activating portion in accordance with the present invention.

In FIG. 3, reference numeral 2004 designates the heat generating resistive layer; 2009 and 2010, the portions where the proportion of metal is smaller with respect to the insulator that forms the heat generating resistive layer. It is preferable to form the insulator with the same material of the interlayer film 2003 and the protection layer 2006. An Si insulator, such as $SiO_2$, SiN, SiC, or the like, may be cited as a preferable one.

Also, for the portions that are in contact with the heat generating resistive layer 2004 and the electrode wiring 2005, conduction is needed. It is, therefore, required to contain metal partly. For metal useable in the present invention, Ta, Cr, W, or some other high fusion point metals may be cited as preferable.

Now, in FIG. 3, using reference numerals 2009 and 2010 the structure is shown for description, but with the exception that the rate of metal contained in these portions is smaller with respect to the insulator, these portions constitute parts of the heat generating resistive layer 2004 as a continuous film.

In this respect, for the heat generating member, it may be possible to arrange its structure so that the rate of metal content is smaller only on the interfaces thereof or that the rate of metal content is made gradually smaller from the center of the film in its thickness direction toward the interfaces.

Also, in order to change the rates of metal content with respect to the insulator of the heat generating resistive layer 2004 in the film thickness direction, it may be possible to change the respective powers by means of the multiple sputtering system using the target that forms the insulator and metal or it may be possible to change the respective powers by means of the multiple reactive sputtering system likewise using a plurality of metal targets, while inducing reactive gas. For example, it may be possible for the former to make formation using $SiO_2$, SiN, SiC, or some other insulator target and Ta, Cr, W, or other metal target. For the latter, it may be possible to make formation by causing Ta, Cr, Si, W, or some other target to react in the nitrogen, oxygen and carbon gas or some other atmosphere. At this juncture, it should be good enough if only the rate of metal is reduced in the vicinity of the interfaces with the interlayer film 2003 and the protection layer 2006.

If the heat generating resistive layer is formed by use of the method described above, it is possible to produce a heat generating resistive layer having a higher specific value of resistance, as well as a significant strength against thermal stress as compared with the conventional one.

Embodiments

Now, with reference to the accompanying drawings, the description will be made of the embodiments in accordance with the present invention. However, it is to be understood that the invention is not necessarily limited to each of the embodiments given below. It is of course possible to use any embodiments that may be adoptable for achieving the objectives of the present invention.

Embodiments 1 to 4

Figure 1:
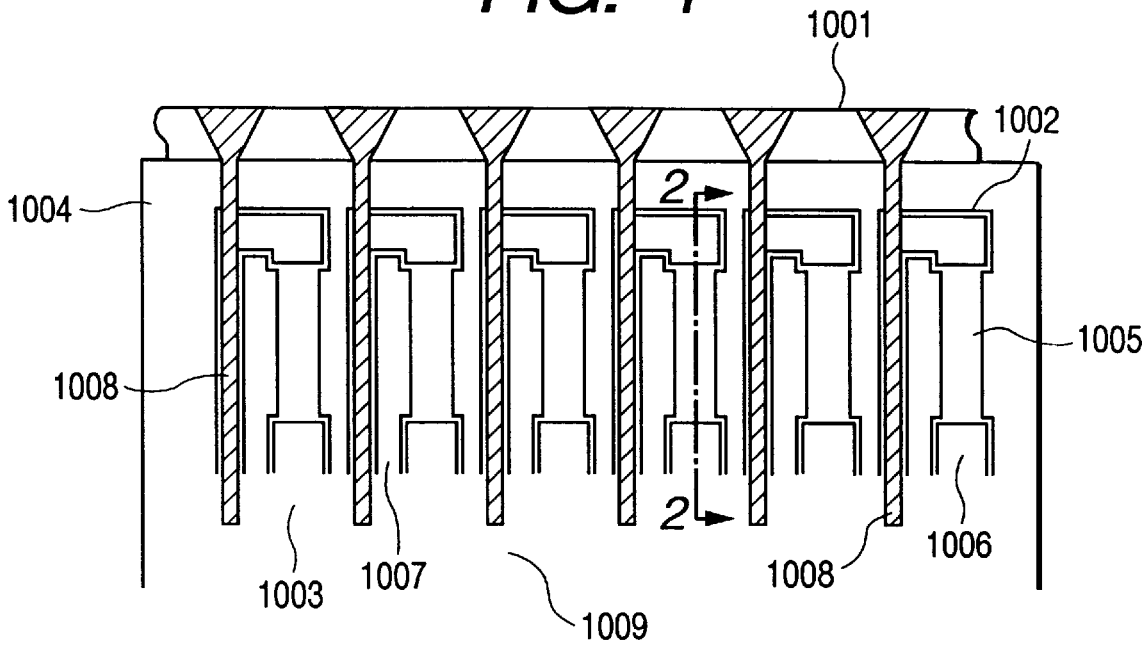
FIG. 1 is a plan view which schematically shows a substrate for use of an ink jet recording head in accordance with one embodiment of the present invention.

FIG. 1 is a plan view which schematically shows the principal part of the heat generating unit of the substrate for foaming ink for an ink jet recording head in accordance with one embodiment of the present invention. FIG. 2 is a cross-sectional view which schematically shows a part of the substrate, taken along line 2—2 perpendicular to the surface of the substrate in FIG. 1.

In accordance with the present embodiment, the substrate 2001 for the heat generating unit is produced using Si substrate or the Si substrate on which driving IC has already been incorporated. For the former, the $SiO_2$ heat accumulation layer 2002 is formed in a film thickness of 1.2 $\mu$m by means of thermal oxidation, sputtering, CVD, or the like. For the latter, that is, the one having the driving IC already incorporated, the $SiO_2$ heat accumulation layer 2002 is formed likewise in the process of its manufacture.

Then, by means of sputtering, CVD or the like, the interlayer insulation film 2003 is formed in a film thickness of 1.2 $\mu$m using SiN or $SiO_2$ as shown in Table 1. Then, the heat generating resistive layer 2004 is formed by means of reactive bisputtering system using Ta and Si targets under conditions shown in Table 2. The gas flow rates and powers applied to the respective targets are conditioned as shown in Table 2, while the substrate temperature is set at 200° C.

TABLE 1

| | Interlayer film | Heat generating resistive layer | Protection layer |
|---|---|---|---|
| Embodiment 1 | SiN | Ta—Si—N | SiN |
| Embodiment 2 | $SiO_2$ | Ta—Si—O | $SiO_2$ |
| Embodiment 3 | $SiO_2$ | Cr—Si—O | $SiO_2$ |
| Embodiment 4 | $SiO_2$ | Ta—Si—O—N | SiN |
| Comparative Example 1 | $SiO_2$ | HfB2 | $SiO_2$ |
| Comparative Example 2 | SiN | Ta2N | SiN |

TABLE 2

| | Film formation time (minute) | Target 1 Power (W) | Target 2 Power (W) | Gas 1 (sccm) | Gas 2 (sccm) |
|---|---|---|---|---|---|
| Embodiment 1 | 0–1 | Ta - 50 | Si - 200 | Ar - 45 | $N_2$ - 15 |
| | 1–2 | Ta - 100 | Si - 150 | Ar - 45 | $N_2$ - 15 |
| | 2–5 | Ta - 600 | Si - 200 | Ar - 45 | $N_2$ - 15 |
| | 5–6 | Ta - 100 | Si - 150 | Ar - 45 | $N_2$ - 15 |

TABLE 2-continued

| | | | | | |
|---|---|---|---|---|---|
| | 6–7 | Ta - 50 | Si - 200 | Ar - 45 | $N_2$ - 15 |
| Embodiment 2 | 0–1 | Ta - 50 | Si - 200 | Ar - 44 | $O_2$ - 16 |
| | 1–2 | Ta - 100 | Si - 150 | Ar - 44 | $O_2$ - 16 |
| | 2–5 | Ta - 580 | Si - 170 | Ar - 44 | $O_2$ - 16 |
| | 5–6 | Ta - 100 | Si - 150 | Ar - 44 | $O_2$ - 16 |
| | 6–7 | Ta - 50 | Si - 200 | Ar - 44 | $O_2$ - 16 |
| Embodiment 3 | 0–1 | Cr - 70 | Si - 200 | Ar - 45 | $O_2$ - 15 |
| | 1–2 | Cr - 100 | Si - 160 | Ar - 45 | $O_2$ - 15 |
| | 2–5 | Cr - 700 | Si - 200 | Ar - 45 | $O_2$ - 15 |
| | 5–6 | Cr - 100 | Si - 160 | Ar - 45 | $O_2$ - 15 |
| | 6–7 | Cr - 70 | Si - 200 | Ar - 45 | $O_2$ - 15 |

| | Film formation time (minute) | Target 1 Power (W) | Target 2 Power (W) | Gas 1 (sccm) | Gas 2 (sccm) | Gas 3 (sccm) |
|---|---|---|---|---|---|---|
| Embodiment 4 | 0–1 | Ta - 50 | Si - 200 | Ar - 45 | $N_2$ - 0 | $O_2$ - 15 |
| | 1–2 | Ta - 100 | Si - 200 | Ar - 45 | $N_2$ - 4 | $O_2$ - 11 |
| | 2–5 | Ta - 800 | Si - 250 | Ar - 45 | $N_2$ - 7 | $O_2$ - 8 |
| | 5–6 | Ta - 100 | Si - 200 | Ar - 45 | $N_2$ - 11 | $O_2$ - 4 |
| | 6–7 | Ta - 50 | Si - 200 | Ar - 45 | $N_2$ - 15 | $O_2$ - 0 |

| | Film formation time (minute) | Target 1 Power (W) | Target 2 Power (W) | Gas 1 (sccm) | Gas 2 (sccm) |
|---|---|---|---|---|---|
| Comparative Example 1 | 0–1 | $SiO_2$ - 700 | HfB2 - 70 | Ar - 60 | 0 |
| | 1–2 | $SiO_2$ - 350 | HfB2 - 200 | Ar - 60 | 0 |
| | 2–5 | 0 | HfB2 - 350 | Ar - 60 | 0 |
| | 5–6 | 0 | HfB2 - 200 | Ar - 60 | 0 |
| | 6–7 | 0 | HfB2 - 70 | Ar - 60 | 0 |
| Comparative Example 2 | 0–1 | SiN - 700 | Ta2N - 70 | Ar - 60 | 0 |
| | 1–2 | SiN - 350 | Ta2N - 200 | Ar - 60 | 0 |
| | 2–5 | 0 | Ta2N - 220 | Ar - 60 | 0 |
| | 5–6 | SiN - 350 | Ta2N - 200 | Ar - 60 | 0 |
| | 6–7 | SiN - 700 | Ta2N - 70 | Ar - 60 | 0 |

Subsequently, the electrode wiring 2005 is formed by means of sputtering using Al film at 5500 Å. Then, by means of photolithography, pattern formation is performed to form the heat activating portion 2008 of 15 μm×40 μm after removing the Al film.

Then, as the protection layer 2006, the insulator of SiN or $SiO_2$ is formed by means of plasma CVD in a film thickness of 1 μm as shown in Table 1. After that, Ta film is formed by means of sputtering as the anti-cavitation layer 2007 in a film thickness of 2300 Å. In this way, the substrate for use of an ink jet recording head (substrate 1004) of the present invention is produced as shown in FIG. 1.

The sheet resistance values of each embodiment and each comparative example are shown in Table 3 to list the results of measurement. In other words, using the substrates thus produced driving is executed under the following conditions for the test of durability against thermal stress by the application of breaking pulses:

Driving frequency: 10 kHz

Driving pulse width: 2 μsec

Driving voltage: bubbling starting voltage Vth×1.3

TABLE 3

| | Sheet resistance value (Ω/□) | Breaking pulse number | Electric current value (mA) |
|---|---|---|---|
| Embodiment 1 | 250 | $4 \times 10^9$ | 37 |
| Embodiment 2 | 270 | $3 \times 10^9$ | 35 |
| Embodiment 3 | 280 | $1 \times 10^9$ | 34 |
| Embodiment 4 | 270 | $2 \times 10^9$ | 35 |

TABLE 3-continued

| | Sheet resistance value (Ω/□) | Breaking pulse number | Electric current value (mA) |
|---|---|---|---|
| Comparative Example 1 | 20 | $2 \times 10^6$ | 144 |
| Comparative Example 2 | 40 | $9 \times 10^8$ | 98 |

Comparative Examples 1 and 2

With the exception of the interlayer film and protection layer being formed by the materials shown in Table 1, and heat generating resistive layers being formed under the conditions shown in Table 2, the substrates are produced as in the embodiments for use of the ink jet recording head. Also, using each of such substrates, the thermal stress durability test is carried out by the application of breaking pulses as in each of the embodiments. The results of measurement are shown in Table 3.

As clear from the results shown in Table 3, the substrates of the present embodiment present not only high resistance values, but also, its excellent durability against the thermal stress. Particularly, in accordance with the method of the present invention for manufacturing a substrate, it is clear that the thermal stress durability is significantly enhanced as compared with the conventional one even when similar materials are used for the formation of the heat generating resistive layers as in the cases of the embodiment 1 and the comparative example 2.

Also, each conventional heat generating resistive layer has a smaller sheet resistance value than each heat generating resistive layer of the present invention. Therefore, the electric current value of the conventional one is considered to become greater two to three times when driven. For an ink jet recording apparatus where numbers of heat generating members are driven, this difference may exert a great influence, presenting a serious problem that should be taken into consideration when an apparatus is designed. Particularly, for the structure that requires a smaller size of heat generating member to meet the requirements of high image quality and higher speed recording, the use of the conventional heat generating members is subjected to the remarkable increase of electric power consumption. In this respect, therefore, using the heat generating members embodying the present invention makes it possible to save energy significantly as compared with the use of the conventional heat generating members.

Also, as far as the conventional heat generating resistive layer is used, there exists a region where its central portion in the film thickness direction should be formed only by the material of the heat generating resistive layer as described earlier. Hence, it is unavoidable that the temperature gradient in the film thickness direction becomes greater. In contrast, the heat generating resistive layer of the present invention is formed by the compound of insulator and metal. Therefore, just by modifying the rate of metal contents in it, the composition of the layer is arbitrarily changeable in the film thickness direction, making it possible to make the temperature gradient of the heat generating resistive layer uniform and also, to increase the freedom of the structural formation in this respect.

Now, hereunder, the description will be made of the general structure of an ink jet recording apparatus to which an ink jet recording head of the present invention is applicable.

Figure 4:
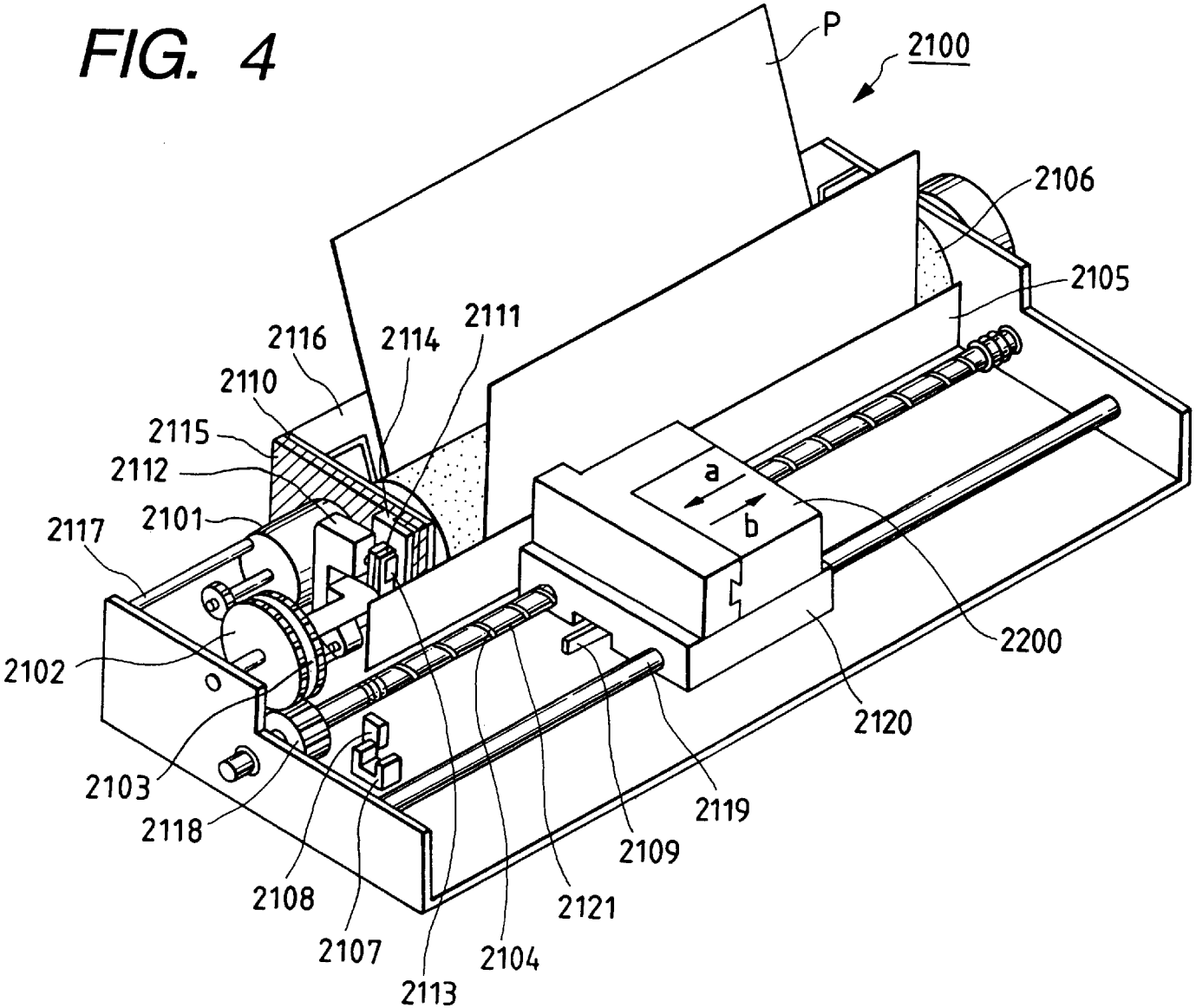
FIG. 4 is a perspective view which shows the outer ppearance of one example of a recording apparatus sing the ink jet recording head embodying the present invention.

FIG. 4 is a perspective view which shows the outer appearance of one example of an ink jet apparatus to which the present invention is applicable. The recording head 2200 is mounted on the carriage 2120, which reciprocates in the directions indicated by arrows a and b together with the carriage 2120 along the guide 2119 by means of the driving power of a driving motor 2101. The carriage 2120 engages with the spiral groove 2121 of the lead screw that rotates through the driving power transmission gears 2102 and 2103 interlocked with the driving motor 2101 that rotates regularly and reversely. The sheet pressure plate 2105, which is used for a recording sheet P to be carried on the platen 2106 by means of a recording medium carrier device (not shown), gives pressure to the recording sheet over the platen 2106 in the traveling direction of the carriage 2120.

Reference numerals 2107 and 2108 designate the photocoupler that serves as home position detecting means for detecting the presence of the lever 2109 of the carriage 2120 within this region in order to switch over the rotational directions of the driving motor 2101; 2110, a member to support the cap member 2111 that caps the entire surface of the recording head 2200; 2112, suction means for sucking liquid from the interior of the cap member, which performs the suction recovery of the recording head 2200 through the aperture 2113 in the cap.

A reference numeral 2114 designates a cleaning blade; 2115, a member to move the blade forward and backward. These are supported by a supporting plate 2116 that supports the main body of the apparatus. The cleaning blade 2114 is not necessarily limited to this mode. The known cleaning blade is of course applicable to this apparatus.

Also, a reference numeral 2117 designates the lever for initiating the suction for the suction recovery, which moves along the movement of the cam 2118 that engages with the carriage 2120. The control of its movement is performed by known transmission means whereby to switch over the driving power from the driving motor 2101 by means of clutch. The recording controller that controls the driving of each mechanism described above is provided for the main body side of the recording apparatus (not shown).

The ink jet recording apparatus 2100 structured as above records on the recording sheet P to be carried on the platen 2106 by means of the recording medium carrier means by causing the recording head 2200 to reciprocate on the entire width of the recording sheet P. Since the recording head 2200 is manufactured by the method described above, it is possible to record highly precise images at high speeds.

As described above, in accordance with the present invention, the heat generating resistive layer between the protection layer and the interlayer film is formed by the compound of insulator and metal, while the rate of metal content is made smaller with respect to the insulator in the vicinity of the interfaces with the protection layer and the interlayer film. Therefore, the generation of interlayer peelings and cracks is prevented or suppressed in the vicinity of the heat generating resistive layer where temperature changes intensely due to thermal cycle.

In accordance with the present invention thus designed, it is possible to provide a substrate that constitutes a long life ink jet recording head having a smaller failure rate, and to provide an ink jet recording head structured using such substrate.

Also, it is possible to provide a substrate that constitutes an ink jet recording head capable of performing ink discharges in good condition for a long time, and to provide an ink jet recording head structured using such substrate. Further, it is possible to provide a substrate that constitutes an ink jet head having a plurality of discharge openings arranged in high density so as to record images in high precision at high speeds, and to provide an ink jet recording head structured using such substrate.

In addition, it is possible to provide an ink jet pen including an ink reservoir unit for retaining ink to be supplied to such excellent ink jet recording head as described above, as well as to provide an ink jet recording apparatus having such ink jet recording head mounted on it.

What is claimed is:

1. A substrate for use in an ink jet recording head provided with a heat generating resistive layer for generating thermal energy used for discharging ink, said heat generating resistive layer having an interface with an interlayer film arranged below said heat generating resistive layer, and an interface with a protection layer for protecting said heat generating resistive layer arranged over said heat generating resistive layer, said heat generating resistive layer comprising a mixture of a metal and an insulator, wherein the proportion of metal content near the interfaces of said heat generating resistive layer is smaller than that in the center of the thickness direction of said heat generating resistive layer.

2. A substrate for use in an ink jet recording head according to claim 1, wherein said metal is selected from at least one of the group consisting of Ta, Cr, and W.

3. A substrate for use in an ink jet recording head according to claim 1, wherein said insulator is Si, $SiO_2$, SiN, or SiC.

4. A substrate for use in an ink jet recording head according to claim 1, wherein said interlayer film is SiN or $SiO_2$.

5. A substrate for use in an ink jet recording head according to claim 1, wherein said protection layer is SiN or $SiO_2$.

6. An ink jet recording head comprising:

a substrate according to one of claim 1 to claim 5;

discharge openings for discharging ink; and ink flow paths arranged on said substrate, conductively connected with said discharge openings and containing said heat generating resistive layer.

* * * * *

UNITED STATES PATENT AND TRADEMARK OFFICE

CERTIFICATE OF CORRECTION

PATENT NO. : 6,068,369
DATED : May 30, 2000
INVENTOR(S) : Ichiro Saito et al.

It is certified that error appears in the above-identified patent and that said Letters Patent is hereby corrected as shown below:

Title page,
Item [57], ABSTRACT,
Line 1, "of" should read -- in --.
Line 2, "in" should read -- of --.

Column 1,
Line 29, "principle" should read -- principal --.
Line 41, "are" should read -- is --.
Line 49, "where" should be deleted.
Line 61, "use of" should read -- use in --.
Line 66, "SiO" should read -- $SiO_2$ --.

Column 2,
Line 3, "SiO" should read -- $SiO_2$ --.
Line 59, "or" should read -- for --.
Line 65, "its" should read -- their --.

Column 5,
Line 6, "ppearance" should read -- appearance --; and "sing" should read -- using --.

Signed and Sealed this

Ninth Day of April, 2002

*Attest:*

*Attesting Officer*

JAMES E. ROGAN
*Director of the United States Patent and Trademark Office*